US008347617B2

(12) United States Patent
Weickert

(10) Patent No.: US 8,347,617 B2
(45) Date of Patent: Jan. 8, 2013

(54) HYDRALIC TWO-CIRCUIT SYSTEM AND INTERCONNECTING VALVE SYSTEM

(75) Inventor: Thomas Weickert, Karsbach (DE)

(73) Assignee: Robert Bosch GmbH, Stuttgart (DE)

( * ) Notice: Subject to any disclaimer, the term of this patent is extended or adjusted under 35 U.S.C. 154(b) by 683 days.

(21) Appl. No.: 12/513,961

(22) PCT Filed: Sep. 13, 2007

(86) PCT No.: PCT/EP2007/007962

§ 371 (c)(1),
(2), (4) Date: Oct. 1, 2009

(87) PCT Pub. No.: WO2008/058584

PCT Pub. Date: May 22, 2008

(65) Prior Publication Data

US 2010/0037603 A1 Feb. 18, 2010

(30) Foreign Application Priority Data

Nov. 15, 2006 (DE) ..... 10 2006 053 897

(51) Int. Cl.
*F15B 11/17* (2006.01)

(52) U.S. Cl. ..... 60/421; 60/422; 60/486; 91/448

(58) Field of Classification Search ..... 137/625.69; 91/448; 60/421, 422, 486, 484
See application file for complete search history.

(56) References Cited

U.S. PATENT DOCUMENTS 3,216,441 A * 11/1965 Thorsheim ..... 137/87.01
5,211,014 A * 5/1993 Kropp ..... 60/421
6,170,261 B1 1/2001 Ishizaki et al.

FOREIGN PATENT DOCUMENTS

| | | |
|---|---|---|
| DE | 41 00 988 | 7/1992 |
| DE | 102 55 738 | 5/2004 |
| DE | 103 54 022 | 6/2004 |
| JP | 10-61608 | 3/1998 |

* cited by examiner

*Primary Examiner* — Edward Look
*Assistant Examiner* — Logan Kraft
(74) *Attorney, Agent, or Firm* — Michael J. Striker

(57) ABSTRACT

A hydraulic two-circuit system (2, 4) for activating consumers (A1, B1; A2, B2; A3, B3) of a mobile unit, for example a track-laying unit, and an interconnecting valve arrangement (38), which is suitable for a two-circuit system (2, 4) of this type and via which the two circuits (2, 4) can be interconnected so as to add them together, are disclosed. According to the invention, the interconnecting valve arrangement has an interconnecting valve with two pressure connections (P1, P2), two LS input connections (LS1, LS2) and two LS output connections, wherein a valve body of the interconnecting valve is designed with four control surfaces, of which two control surfaces which act in one direction are acted upon by the highest load pressure (LS1) in the first circuit and by the pumping pressure (P2) in the second circuit, and the control surfaces acting in the other direction are acted upon by the highest load pressure (LS2) in the second circuit and by the pumping pressure (P1) in the first circuit.

12 Claims, 3 Drawing Sheets

HYDRALIC TWO-CIRCUIT SYSTEM AND INTERCONNECTING VALVE SYSTEM

The present invention relates to a hydraulic dual-circuit system for activating consumers of a mobile device, in particular a crawler-track device according to the preamble of claim 1, and to an interconnecting valve system for a dual-circuit system of this type.

U.S. Pat. No. 6,170,261 B1 discloses a hydraulic dual-circuit system of a mobile device, e.g. a chain-operated device or crawler-track device. In crawler-track devices of this type, the ground drive includes two chains, each of which may be controlled separately via one of the hydraulic circuits. A rotating mechanism and assemblies of the equipment, e.g. the jib, the shovel arm, and the shovel, are also connected to the two hydraulic circuits of the chain-operated device. Each of the hydraulic circuits is supplied with pressure medium by a variable-displacement pump which is controlled as a function of the highest load pressure of the consumers in the assigned circuit.

For the case in which at least one consumer within the equipment should be actuated in addition to the two chains, it is possible to interconnect the two hydraulic circuits in order to prevent an undersupply of pressure medium from occurring. In the solution disclosed in U.S. Pat. No. 6,170,261 B1, this interconnection of the two hydraulic circuits takes place via an interconnecting valve, via which the pressure lines which are connected to the two pumps, and the load-pressure signaling lines of the two circuits are interconnected. The interconnecting valve is activated as a function of the delivery of pressure medium to the additional consumer. The operator may also intervene manually and connect the two circuits.

The disadvantage of this solution is that, e.g. when one of the consumers that is connected to a hydraulic circuit is activated with a high demand for pressure medium and low pressure, and when one of the consumers that is connected to the other circuit is activated with a low quantity demand and high pressure, then the two circuits are connected via the interconnecting valve, with the result that the higher load pressure of pump of the first circuit is activated, thereby raising both circuits to the higher pressure level. The pressure in the former hydraulic circuit must then be regulated back down to the required pressure level, which results in considerable energy losses. A further disadvantage is the fact that, according to the solution described in U.S. Pat. No. 6,170,261 B1, a great deal of circuit engineering is required to tap the load pressure from the additional consumer, and to activate the interconnection valve.

DE 102 545 738 A1 which belongs to the current applicant discloses an improved dual-circuit system, in the case of which an interconnecting valve system is designed to include two pressure scales, each one of which is assigned to one of the circuits, and via which the connection to the other circuit may be controlled open as a function of the load pressure and the pump pressure in the associated circuit. The disadvantage of this solution is that the interconnecting valve system has a relatively complex design.

In contrast, the object of the present invention is to create a hydraulic dual-circuit system and an interconnecting valve system that is suitable for use therewith and that has a simple design.

This object is attained with regard for the hydraulic dual-circuit system having the features of claim 1, and with regard for the interconnecting valve system via the features of independent claim 12.

According to the present invention, the interconnecting valve system which is required to combine the volumetric flows of pressure media of a dual-circuit system is formed essentially by an interconnecting valve which is designed to include at least four control surfaces; two control surfaces which are active in one direction are acted upon by the highest load pressure in a first circuit and by the pump pressure in the second circuit, and the other control surfaces which are active in the opposite direction are acted upon by the highest load pressure in this circuit and by the pump pressure in the first circuit. Depending on the resultant control-pressure difference, it is then possible to connect, for purposes of combining, two pressure ports and one LS input port assigned to the first circuit to an LS output circuit assigned to the second circuit, thereby preventing a higher load pressure—which is active in one of the circuits—with a low pressure-medium demand from being signaled into the other circuit which has a lower load pressure and a high pressure-medium demand. In both circuits, only the load pressure that corresponds to the actual requirements is signaled to the particular assigned variable-displacement pump; as a result, if a high pressure and low pressure-medium demand exist in one of the circuits, the variable-displacement pump for this circuit is not activated, thereby minimizing the energy losses considerably as compared to conventional solutions. However, if a high pressure and high pressure-medium demand exist in one of the circuits, then, according to this solution, this high pressure is signaled to the second circuit if the load pressure therein is lower.

According to a preferred embodiment, a valve body of the interconnecting valve is preloaded in a blocking position via a centering spring system.

Non-return valves are provided in the load-signaling lines in order to prevent a higher load pressure from being signaled by the connected circuit to the other circuit when the interconnecting valve is open.

According to one embodiment, an LS line of one circuit is connected to an LS output port of the interconnecting valve, which is assigned to the other circuit.

In a particularly preferred embodiment, the control surfaces of the valve body that are acted upon by the pump pressure and the load pressure are designed to be equal in size.

The interconnecting valve is particularly simple in design when the pump pressure and the load pressure of one circuit each act on a rear end face which limits a spring chamber, and the pump pressure and load pressure of the other circuit act on annular end faces of the valve body.

A valve body of the interconnecting valve is preferably designed to include a central control collar, on which two control edges are formed to control open the connection between the two pressure ports. The valve body also includes two outwardly-lying LS control collars, on each of which a control edge is formed to control open the connection between the LS input port of the one circuit, and the LS output port of the other circuit. The rear surfaces—which are located on the side facing the spring chamber—of the two control collars form the rear end faces mentioned above.

A further collar is preferably formed between the central control collar and an LS control collar, on which the annular end face described above is located.

A design of this type makes it possible to create a symmetrical valve body, thereby greatly simplifying manufacture and assembly.

The design of the interconnecting valve is simplified further when the non-return valves described above are integrated in the valve housing of the interconnecting valve.

Other advantageous developments of the present invention are the subject matter of further dependent claims.

A preferred embodiment of the present invention is explained below in greater detail with reference to schematic drawings.

Figure 1:
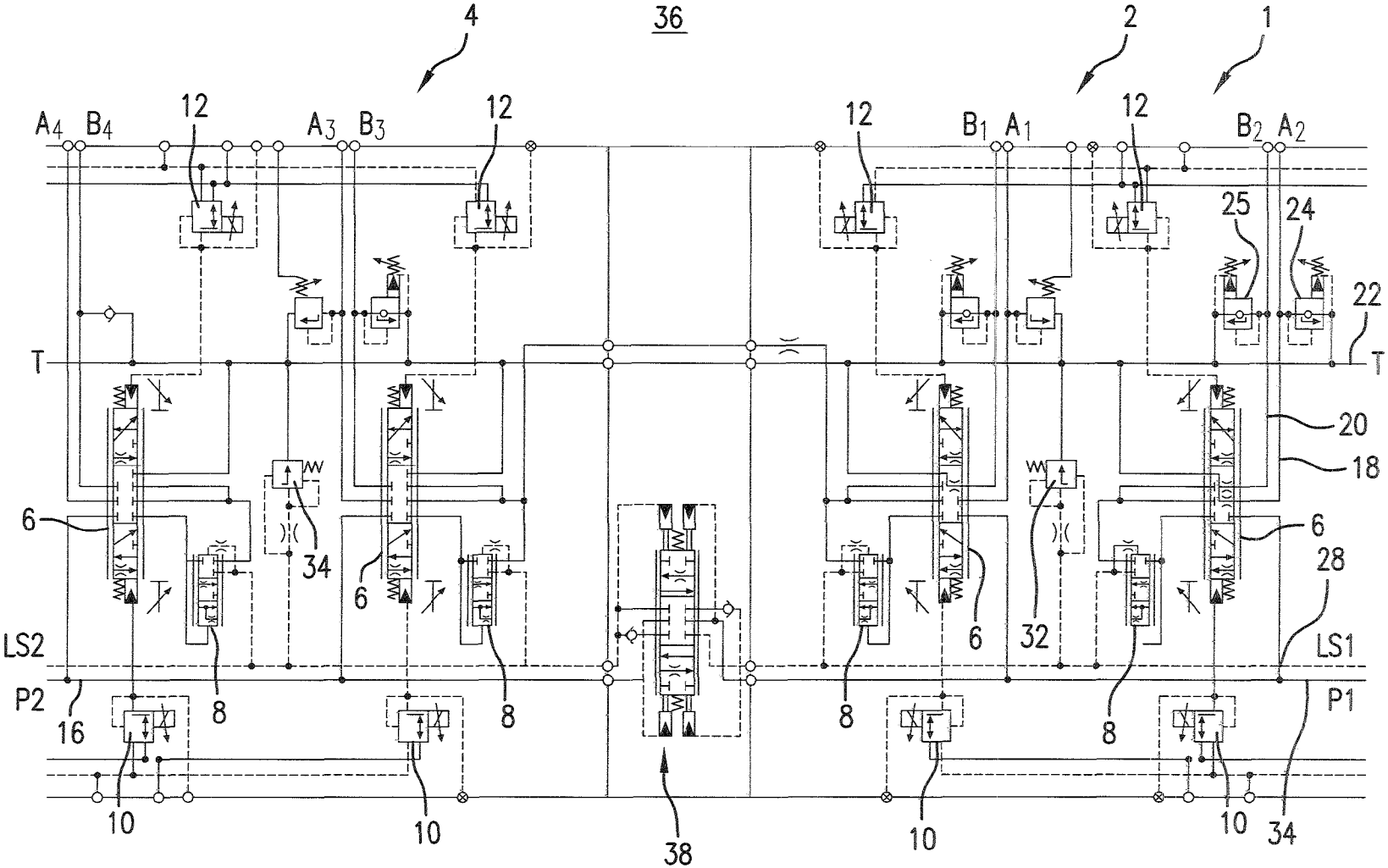
FIG. 1 shows a wiring diagram of a control block for activating a crawler-track device.

FIG. 1 shows a wiring diagram of a hydraulic excavator control system 1 which is designed as a dual-circuit system that includes two hydraulic circuits 2, 4, each of which is supplied with pressure medium via a variable-displacement pump which is not depicted. The excavator that is equipped with the control system depicted in FIG. 1 includes a traction gear having two chains, the crawler drives of which may be supplied with pressure medium independently of one another, via circuits 2, 4. In addition to the crawler drive, further consumers of the excavator are activated via the dual-circuit system, e.g. a rotating mechanism, an arm, a shovel, or a jib.

The control block that is used to realize the excavator control system depicted in FIG. 1 has a plate-type design in which the two variable-displacement pumps (not depicted) are connected to pressure ports $P_1$ and $P_2$ of the control block. The control block also includes a tank port T and working ports $A_1$, $B_1$ and $A_2$, $B_2$, to which the drive of the left and right chains, respectively, are connected. The further consumers of the excavator, e.g. the drive of the rotating mechanism, the hydrocylinder that is used to actuate the arm, the shovel, or the jib, are connected to further ports $A_3$, $B_3$ and $A_4$, $B_4$, etc. In the embodiment shown, it is assumed that the jib is connected to ports $A_2$, $B_2$, and that the shovel is connected to port $A_4$, $B_4$.

The control block shown also includes two load-pressure ports which are referred to as $LS_1$ and $LS_2$ below, via which the load pressure that exists in particular circuit 2, 4 is tapped and directed to the delivery flow control valve (not depicted) of the variable-displacement pump which is therefore activated as a function of this highest load pressure.

The activation of the aforementioned consumers takes place via a proportionally adjustable directional control valve 6, downstream of which a pressure scale 8 is connected. Directional control valve 6 includes a velocity part, which forms an adjustable metering orifice, and a direction part; the metering orifice is installed upstream of pressure scale 8, and the direction part is located downstream of pressure scale 8. Every pressure scale 8 is acted upon in the closing direction by the load pressure, and in the opening direction by the pressure downstream of the metering orifice of directional control valve 6. The pressure-scale piston assumes a control position as a function of the control pressures that are present; in the control position, the pressure drop is held constant via the metering orifice of the proportionally adjustable, directional control valve 6, thereby making it possible to control the volumetric flow independently of load pressure. LS controls of this type have been known for a long time, so it is unnecessary to provide a detailed description of the design of directional control valve 6 and downstream pressure scale 8. Directional control valve 6 is activated via pilot valves 10, 12, via which a control pressure is applied to the control surfaces on the front face of a sliding element of directional control valve 6. These pilot valves are actuated, e.g. as a function of the actuating motion of a joystick.

The ports of directional control valves 6 are connected via a pressure line 14, 16 to pressure port $P_1$ or $P_2$, respectively In addition, every directional control valve includes two working ports which are connected via a working line 18 or 20 to assigned consumer ports A, B. To return the pressure medium from the consumer, an output port of directional control valve 6 is connected via a tank line 22 to tank port T of the control block.

Pressure-limiting valves are installed in the working lines in order to limit the maximum pressure that is sent to the consumer; the pressure-limiting valves that limit the pressure at working ports $A_2$, $B_2$, $B_1$ and $B_3$, and $A_4$ (not depicted) are designed to have an anti-cavitation function, so that, if the consumer advances (negative load), pressure medium may be fed from the tank in order to prevent cavitation. A load-pressure signaling line 28, 30 which is connected to load-pressure port LS of circuits 2, 4 is connected via an LS flow-regulating valve 32 or 34 to common tank line 22.

Pressure scales 8 are designed such that, when they are in their fully opened end position, they signal the pressure that is present at their inlet (the pressure downstream of the metering orifice) to load-pressure line 28 or 30, thereby ensuring that the highest load pressure in particular circuit 2 or 4 is always present in load-pressure line 28 or 30.

The directional control valves described above which include assigned pressure scale 8, pilot valves 10, 12, and pressure-limiting valves 24, 25 may be accommodated in a plate or in a common control block. To connect the two hydraulic circuits 2, 4, an interconnecting valve system 38 is provided in an intermediate plate 36, via which, under certain operating conditions, pressure lines 14, 16 of hydraulic circuits 2, 4 may be interconnected, thereby enabling the activated consumers to be supplied jointly with pressure medium using the two variable-displacement pumps.

The design of the interconnecting valve system will be described below with reference to FIGS. 2 and 3.

According to the circuit symbol of interconnecting valve system 38 shown in FIG. 2, interconnecting valve system 38 includes an interconnecting valve 40 which is designed as a pressure scale, the pressure-scale sliding element of which is referred to below as valve body 42 and includes four control surfaces A1, A2, A3, A4; two control surfaces A1, A2 which act in one direction are acted upon by the pump pressure of the second circuit and the load pressure of the first circuit, and control surfaces A3, A4 which act in the opposite direction are acted upon by the pump pressure of the first circuit and the load pressure in the second circuit. Accordingly, control surface A1 is connected via a pressure-control line 44 to pressure line 16 of second circuit 4, and control surface A2 which acts in the same direction is connected via an LS control line 46 to load-pressure signaling line 28 of the first circuit. Control surfaces A3, A4 which act in the opposite direction are connected via a further pressure control line 48 to pressure line 14 or a further LS control line 50 to load-pressure signaling line 30 of the second circuit. The surfaces of control surfaces A1, A2, A4 and A3 are identical.

Valve body 42 is preloaded via a centering spring system 51 in a central blocking position in which two pressure ports P1 and P2 which are connected to pressure lines 14, 16, two ports LS1 and LS1' which are assigned to first circuit 2, and two ports LS2, LS2' which are assigned to second circuit 4 are blocked.

LS input port LS1 is connected via an LS channel 52 and a non-return valve 54 which opens in the direction toward port LS1 to load-pressure signaling line 28 of first circuit 2, to which LS outlet port LS1' is also connected, via an LS branch channel 56. Accordingly, load-pressure signaling line 30 of second circuit 4 is connected via a further LS channel 58 and a further non-return valve 60 to LS input channel LS2, and via a further LS channel 62 to LS output port LS2'. Depending on the control-pressure difference that is present, it is possible to displace valve body 42 of interconnecting valve 40 upwardly (as shown in FIG. 2) into a control position labeled "b", or downwardly into a control position labeled "a". In control positions a, b, the volumetric flow of pressure medium of the circuit having the higher pressure level, and which was added to the other circuit, is throttled down to the lower pressure level via sequence valve 40. The control position is assumed when the pressure differential between the pump pressure and the load pressure in the first circuit is approximately equal to that which is present in the second circuit. In control positions "a", pressure medium from second circuit 4 is added to the volumetric flow of the pressure medium of first circuit 2, and LS ports LS1 and LS2' are connected to one another, while the two other LS ports, LS2 and LS1', are blocked from one another. When the load pressure in first circuit 2 is lower, non-return valve 54 prevents the higher load pressure in second circuit 4 from being signaled to the first circuit, thereby preventing the variable-displacement pump which is assigned to the first circuit from being activated in this case. In the case in which the higher load pressure is present in first circuit 2, this is signaled to the variable-displacement pump of the second circuit via non-return valve 54 which opens, and by connected LS ports LS1 and LS2', thereby activating the variable-displacement pump.

Accordingly, when displacement occurs into one of the control positions b, pressure ports P1 and P2 are connected to one another, thereby enabling pressure medium from the first circuit to be added to the volumetric flow of the pressure medium of the second circuit, and connecting LS ports LS2 and LS1' to one another; non-return valve 60 prevents a lower load pressure in first circuit 2 (in load-pressure signaling line 28) from being signaled to load-pressure signaling line 30 of second circuit 4.

Figure 2:
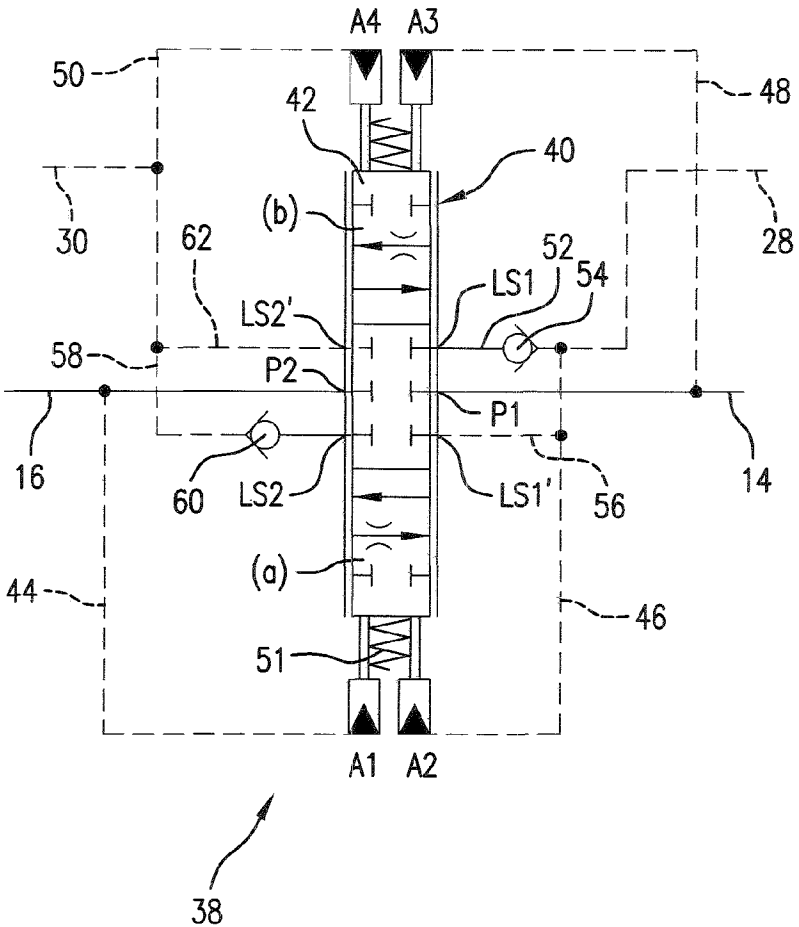
FIG. 2 shows a circuit symbol for an interconnecting valve system of a dual-circuit system or multiple-circuit system as depicted in FIG. 1.
Figure 3:
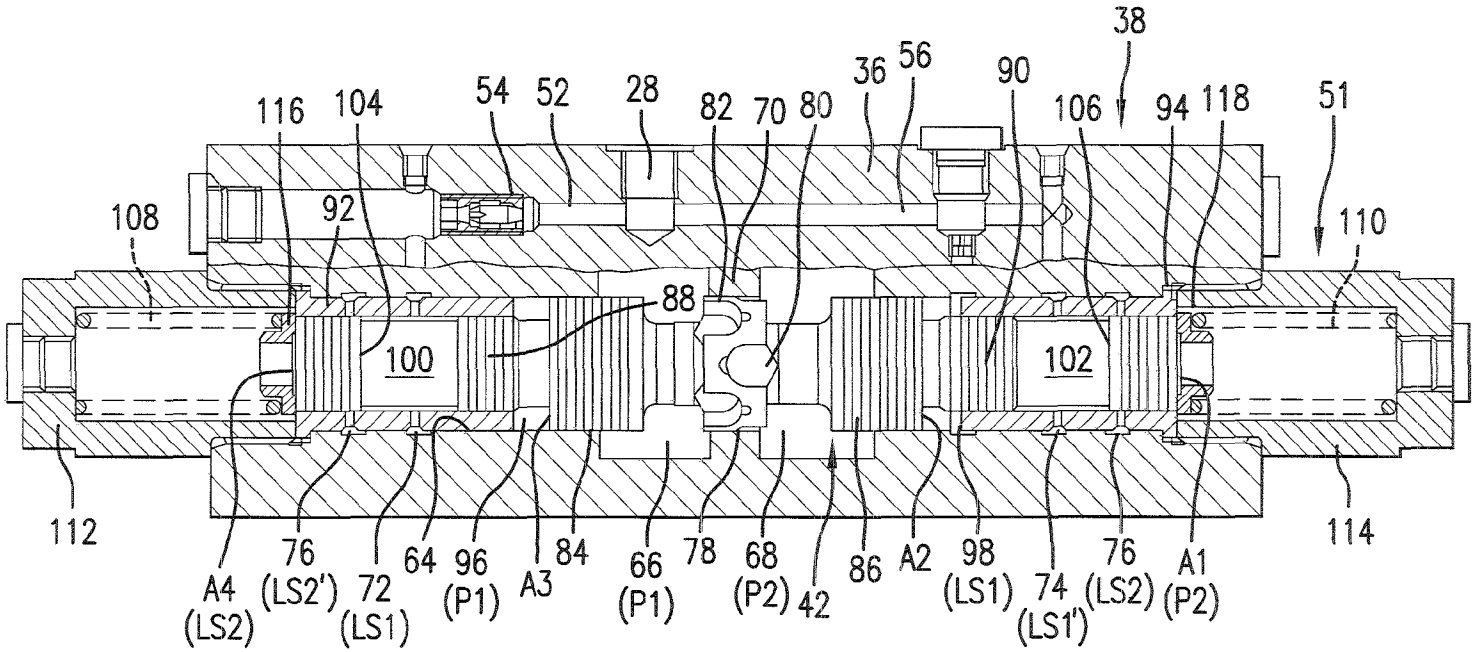
FIG. 3 shows a specific design of the interconnecting valve system in FIG. 1.

FIG. 3 shows a specific embodiment of an interconnecting valve system 38 as shown in FIG. 2.

As described initially, interconnecting valve system 38 may be integrated in intermediate plate 36 of the control block, or it may be placed on the control block as a separate valve. FIG. 3 shows a longitudinal view through valve disk 36 or through a valve housing which accommodates interconnecting valve system 38. A valve bore 64 is formed in valve disk 36, in which the pressure-scale sliding element or valve body 42 is guided in a manner such that it may be displaced axially. In its central region, valve bore 64 is expanded to form two pressure chambers 66, 68 which are separated from one another by housing segment 70. Pressure chamber 66 is connected to pressure port P1, and pressure chamber 68 is connected to pressure port P2. In the direction toward its end sections, the valve bore is expanded in the radial direction to form LS annular spaces 70, 72 and 74, 76; outwardly-situated annular spaces 70, 76 are connected to load-pressure signaling channel 30; the highest load pressure of second circuit 4 is therefore present in these chambers. The two inwardly-lying annular spaces 72, 74 are acted upon accordingly via load-pressure signaling line 28 and, therefore, by the highest load pressure of first circuit 2. The cross-sectional view presented in FIG. 3 shows load-pressure signaling lines 28, LS channel 52 which leads to annular chamber 72, non-return valve 54 which is situated in LS channel 52, and LS branch channel 56 which leads to annular chamber 74. The connection of the two other annular chambers 70, 76 to load-pressure signaling line 30 takes place via appropriate channels which include an integrated non-return valve 60 (not depicted in FIG. 3).

Valve body 42 includes a central control collar 78, on which two control edges 80, 82 are formed, control edges 80, 82 being designed to include fine-control notches. When valve body 42 is displaced axially, the connection between pressure chambers 66, 68 is controlled open via one of the control edges 80, 82; pressure chambers 66, 68 are connected to pressure lines 14 and 16, as mentioned above. In the illustration shown in FIG. 2, pressure chamber 66 is connected to port P1, and pressure chamber 68 is connected to port P2. To facilitate understanding, the port labels are shown in parentheses in FIG. 3.

At an axial distance from central control collar 78, valve body 42 includes two collars 84, 86 on either side; collars 84, 86 are connected via a radially recessed piston neck to an outwardly lying control collar 88 and 90. Each control collar 88, 90 is guided in a reducing sleeve 92 and 94, each of which is inserted into an end section of valve bore 64—the end section being expanded in a stepped manner on the front face of valve bore 64—thereby reducing the effective guide diameter for the valve body 42 and creating a difference between the surfaces. An annular front face is provided on the front faces of collars 84 and 86 which point toward control collars 88, 90 and form control surfaces A2 and A3.

In conjunction with the adjacent front face of reducing bushing 92, control surface A3 limits a chamber 96 in which the pressure in pressure line 14 and, therefore, at pressure port P1, is present. In conjunction with the adjacent front face of reducing bushing 94, annular front face A2 of collar 86 limits a further chamber 98 in which the pressure in pressure line 16 and, therefore, at pressure port P2, is present. Outwardly-lying control collars 88, 90 are stepped inwardly slightly in the center by a piston neck 100, 102, thereby forming a control edge 104, 106. Via control edge 104 which is situated on the left in FIG. 2, it is possible to control open the connection between annular chambers 72 and 70, and, via control edge 106 on the right, it is possible to control open the connection between annular chambers 74, 76. In the neutral position of valve body 42 shown, the connection is blocked by control edges 104 and 106.

The two front faces of valve body 42 form control surfaces A1 and A1 (see FIG. 2) which are acted upon by the pressure in pressure line 16 of the second circuit, and by the highest load pressure of the second circuit.

In the embodiment shown, front faces A1, A4, and annular front faces A2, A3 are identical in design.

As explained above with reference to FIG. 2, valve body 42 is preloaded in its central position shown by centering spring system 51. Centering spring system 51 also functions as a control spring system, and, in a specific embodiment, it is designed to include two control springs 108, 110, the spring constant of which are designed such that it is slightly below the pump $\Delta p$. Given a pump $\Delta p$ of approximately 20 bar, the spring force of a control spring 108, 110 approximately corresponds to a pressure of delta-p difference: 3 to 6 bar (determined via experimentation).

Control springs 108, 110 each bear against a spring bushing 112, 114 which is screwed into valve bore 64, and they each act via a spring plate 116, 118 on front faces A1, A4 of valve body 42. The annular front faces of reducing bushings 92, 94 which are enlarged in the radial direction and point toward control springs 108, 110 are used as end stops for spring plate 116, 118. The central position of valve body 42 shown is also determined via these two end stops.

An operating state of the excavator control is described below, to better explain the mode of operation.

It is assumed that the consumer that is connected to working ports A2, B2, e.g. the arm, requires a large quantity of pressure medium, and that the pump pressure which is present in hydraulic circuit 2 is therefore relatively low. In contrast, the consumer that is connected to working ports A4, B4 of the second circuit, e.g. the jib, should require only a small quantity of pressure medium at a relatively high pump pressure.

Due to the pressure drop in first circuit 2 (low pressure in pressure line 14), valve body 86 is displaced to the left (as shown in FIG. 3) against the force of control spring 108, thereby activating the pressure-medium flow path between pressure chambers 86, 66 via control edge 80 and its fine-control notches, thereby resulting in pressure medium from second circuit 4 being added to first circuit 1 (pressure-medium flow from P1 to P2 of interconnecting valve 40). In parallel therewith, the connection between LS annular chambers 70, 72 is activated via control edge 104, thereby opening the connection between LS input port LS1 and LS output port LS2'. Non-return valve 54 ensures that a higher load pressure in second circuit 4 is not signaled into first circuit 2 which receives pressure medium from the second circuit. Interconnecting valve 40 which operates according to the pressure-scale principle assumes a control position, thereby throttling the pressure medium that is pumped by the variable-displacement pump of second circuit 4 to the pressure level that exists in first circuit 2, so that the pressure differentials (pump pressure–load pressure) in the two circuits are nearly identical.

The energy saving for this case is calculated as follows:

$$P_{arm} = 60 \text{ bar } Q_{arm} = 300 \text{ l/min}$$

$$P_{jib} = 140 \text{ bar } Q_{jib} = 100 \text{ l/min}$$

$$\text{2-circuit: } Q_{Pump1} = Q_{Pump2} = 200 \text{ l/min}$$

$$\text{1-circuit: } Q_{P(1st\ circuit)} = 400 \text{ l/min}$$

$$P_{(2-circuit)} = \frac{P_{arm} \cdot Q_{Pump2} + P_{jib} \cdot Q_{Pump1}}{600}[\text{kW}] = \frac{60 \cdot 200 + 140 \cdot 200}{600}[\text{kW}] = 66.6 \text{ kW}$$

$$P_{(1-circuit)} = \frac{P_{arm} \cdot Q_{P(1-circuit)}}{600}[\text{kW}] = \frac{140 \cdot 400}{600} = 93.3 \text{ kW}$$

=> power saved in this example: 28.6%

$$\left[\text{in which } \frac{1}{600} \text{ of the conversion factor of } \frac{l}{\text{min}} \times \text{bar is in kW}\right]$$

When first circuit 2 is added to second circuit 4, valve body 42 is displaced to the right, as shown in FIG. 3, thereby activating—via control edge 82—the connection from pressure chamber 66 to pressure chamber 68, and, therefore, the pressure-medium flow path from pressure port P1 to pressure port P2. At the same time, the connection between LS annular chambers 74, 76 is activated via control edge 106; a higher load pressure in circuit 4 which receives pressure medium is signaled to the variable-displacement pump of first circuit 2, which is then activated. If the load pressure in second circuit 4 is lower, non-return valve 60 prevents the higher load pressure from being signaled to the circuit.

The solution according to the present invention is characterized by an extremely compact design which may be realized using a minimal amount of device engineering.

Disclosed herein are a hydraulic dual-circuit system for activating consumers of a mobile device, e.g. a crawler-track device, and an interconnecting valve system which is suitable for use with a dual-circuit system of this type, via which the two circuits may be interconnected in order to be combined. According to the present invention, the interconnecting valve system includes an interconnecting valve having two pressure ports, two LS input ports, and two LS output ports; a valve body of the interconnecting valve is designed to include four control surfaces; two control surfaces that act in one direction are acted upon by the highest load pressure in the first circuit and by the pump pressure in the second circuit, and the control surfaces that act in the opposite direction are acted upon by the highest load pressure in the second circuit and by the pump pressure in the first circuit.

What is claimed is:

1. A hydraulic dual-circuit system for activating consumers of a mobile device, in particular a crawler-track device, in the case of which a variable-displacement pump is assigned to each hydraulic circuit (2, 4), via which the assigned consumers may be supplied with pressure medium, it being possible to connect the two circuits (2, 4) via an interconnecting valve system (38) in a manner such that the variable-displacement pump of one circuit (2, 4) pumps pressure medium into the other circuit (4, 2), and it being possible to activate the variable-displacement pumps as a function of the load pressure in the assigned circuit (2, 4), wherein the interconnecting valve system (38) includes an interconnecting valve (40) having two pressure ports (P1, P2), two LS input ports, and two LS output ports (LS1, LS2; LS1', LS2'), and a valve body (42) which is acted upon in one direction by the highest load pressure in the first circuit (2) and by the pump pressure in the second circuit (4), and, in the opposite direction, by the highest load pressure in the second circuit (4), and by the pump pressure in the first circuit (2), so that, depending on the resultant control pressure differential acting on the valve body (42), it possible to connect the two pressure ports (P1, P2) and one LS input port (LS1, LS2) which is assigned to one circuit to one LS output port (LS1', LS2') which is assigned to the other circuit.

2. The dual-circuit system as recited in claim 1, in which case the valve body (42) is preloaded in a blocking position via a centering spring system (51).

3. The dual-circuit system as recited in claim 1, in which case a non-return valve (54, 60) which is open toward the LS input port (LS1, LS2) is situated in each LS line (52, 62) which leads to the LS input port (LS1, LS2).

4. The dual-circuit system as recited in claim 3, in which case the LS line (52, 62) of one circuit (2, 4) is connected to an LS output port (LS1', LS2') which is assigned to the other circuit (2, 4).

5. The dual-circuit system as recited in claim 1, in which a plurality of control surfaces (A1, A2, A3, and A4) located on the valve body (42) that are acted upon with the pump pressure and the load pressures are identical in size.

6. The dual-circuit system as recited in claim 5, in which case the pump pressure and the load pressure of one circuit (2) each act on a rear end face (A1, A4) which limits a spring chamber, and the pump pressure and load pressure of the other circuit (4) act on an annular end face (A2, A3) of the valve body (86).

7. The dual-circuit system as recited in claim 6, comprising a central control collar (78), on which two control edges (80, 82) are integrally formed to control open the connection between the two pressure ports (P1, P2), and comprising two outwardly-lying LS control collars (88, 90) on each of which a control edge (104, 106) is formed to control open the connection between an LS input port (LS1, LS2) of one circuit (2, 4) to the LS output port (LS1', LS2') of the other circuit (2, 4), the rear surfaces of which—which are located on the spring-chamber side—form the front faces (A1, A4).

8. The dual-circuit system as recited in claim 7, in which case a collar (84, 86) is formed between the control collar (78) and an LS control collar (90, 92), on which the annular end face (A2, A3) is located.

9. The dual-circuit system as recited in claim 7, in which case the valve body (42) is symmetrical in design relative to the central control collar (78).

10. The dual-circuit system as recited in one of the claims that refer to claim 3, in which case the non-return valves (54, 60) are located in a valve housing of the interconnecting valve (40).

11. The dual-circuit system as recited in one of the claims that refer to claim 2, in which case the centering spring system (2) includes control springs (108, 110), the pressure equivalent of which is slightly less than the pump Δp.

12. An interconnecting valve system for a hydraulic dual-circuit system, comprising an interconnecting valve (40) which includes two pressure ports (P1, P2), two LS input ports, and two LS output ports (LS1, LS2; LS1', LS2'), and a valve body (42) which is acted upon in one direction by the highest load pressure in a first circuit (2) and by the pump pressure in the second circuit (4), and, in the opposite direction, it is acted upon by the highest load pressure in the second circuit (4), and by the pump pressure in the first circuit (2), so that, depending on the resultant control pressure differential acting on the valve body (42), it possible to connect the two pressure ports (P1, P2) and one LS input port (LS1, LS2) which is assigned to one circuit to one LS output port (LS1', LS2') which is assigned to the other circuit.

* * * * *